US009452870B1

(12) United States Patent
Anderson

(10) Patent No.: US 9,452,870 B1
(45) **Date of Patent: *Sep. 27, 2016**

(54) TWO-PIECE DOUBLE-SEALED DISPENSING CAPSULE WITH BUTTON BLAST AND DRINK THROUGH FEATURE

(71) Applicant: Michael Anderson, Hillsboro Beach, FL (US)

(72) Inventor: Michael Anderson, Hillsboro Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/627,487

(22) Filed: Feb. 20, 2015

Related U.S. Application Data

(63) Continuation-in-part of application No. 13/752,493, filed on Jan. 29, 2013, now Pat. No. 8,960,424, which is a continuation-in-part of application No. 13/478,419, filed on May 23, 2012, now Pat. No. 9,132,950, application No. 14/627,487, which is a continuation-in-part of application No. 13/480,958, filed on May 25, 2012, now Pat. No. 8,839,982.

(60) Provisional application No. 61/490,971, filed on May 27, 2011, provisional application No. 61/490,920, filed on May 27, 2011.

(51) Int. Cl.
*B65D 81/32* (2006.01)
*B65D 51/28* (2006.01)
*B65D 85/72* (2006.01)

(52) U.S. Cl.
CPC ..... *B65D 51/2828* (2013.01); *B65D 85/72* (2013.01)

(58) Field of Classification Search
CPC ..... B65D 81/32; B65D 81/3211; B65D 81/3205; B65D 81/3255; B65D 51/28; B65D 51/2814; B01F 13/005; A61J 1/2096; Y10S 215/08
USPC ..... 206/222, 219, 220; 215/DIG. 8; 220/521; 222/83
See application file for complete search history.

(56) References Cited

U.S. PATENT DOCUMENTS

| | | | | |
|---|---|---|---|---|
| 2,445,395 | A | 7/1948 | Greene et al. | |
| 2,653,610 | A | 9/1953 | Smith | |
| 2,659,370 | A | 11/1953 | Smith | |
| 2,721,552 | A | 10/1955 | Nosik | |
| 3,156,369 | A | 11/1964 | Bowes et al. | |
| 3,167,217 | A | 1/1965 | Corsette et al. | |
| 3,220,588 | A * | 11/1965 | Lipari | A61J 1/2093 206/222 |
| 3,221,917 | A | 12/1965 | De Santo et al. | |
| 3,347,410 | A | 10/1967 | Schwartzman | |
| 3,430,795 | A | 3/1969 | Laufer | |

(Continued)

*Primary Examiner* — Steven A. Reynolds
(74) *Attorney, Agent, or Firm* — Malin Haley DiMaggio & Bowen, P.A.

(57) ABSTRACT

A dispensing capsule has an actuation cap including an internal punch, a cap body including a container connector, an ingredient-storing chamber disposed in the container connector and sealed by a lower sealing member, and an actuator base extending above said container connector. A sealed nozzle is attached to the chamber by a circumferentially disposed flexible actuator. A vented moveable plunger extends downward from the nozzle and is disposed within the chamber. The actuation cap is slidingly engaged with cap body at the actuator base. Upon application of pressure to actuation cap, the internal punch engages the nozzle causing the plunger to displace downward and break the lower sealing member to dispense the ingredients into a target container for mixture. The punch of the actuation cap is also capable of breaking the seal in the nozzle to provide drink-through access to the eventual mixture.

8 Claims, 6 Drawing Sheets

(56) References Cited

U.S. PATENT DOCUMENTS 3,443,713 A 5/1969 Kosar
3,521,745 A * 7/1970 Schwartzman .... B65D 81/3211 206/222
3,548,562 A 12/1970 Schwartzman
3,768,697 A * 10/1973 Lerner ..... B67B 7/26 222/80
3,802,604 A 4/1974 Morane et al.
3,924,741 A 12/1975 Kachur et al.
4,024,952 A 5/1977 Leitz
4,073,406 A 2/1978 Goncalves
4,247,001 A 1/1981 Wiegner
4,465,183 A 8/1984 Saito et al.
4,798,287 A 1/1989 Groves et al.
4,821,875 A 4/1989 Groves et al.
4,832,214 A 5/1989 Schrader et al.
4,903,865 A 2/1990 Janowitz
4,982,875 A 1/1991 Pozzi et al.
5,027,872 A 7/1991 Taylor et al.
5,038,951 A 8/1991 Rizzardi
5,088,627 A 2/1992 Musel
5,255,812 A 10/1993 Hsu
5,352,196 A 10/1994 Haber et al.
5,370,222 A 12/1994 Steigerwald et al.
5,482,172 A 1/1996 Braddock
5,598,951 A 2/1997 DeBano, Jr.
5,782,345 A 7/1998 Guasch et al.
5,794,802 A 8/1998 Caola
5,839,573 A 11/1998 Morini
5,863,126 A 1/1999 Guild
5,884,759 A 3/1999 Gueret
5,950,819 A 9/1999 Sellars
6,003,728 A * 12/1999 Elliott ..... B65D 47/0804 206/219
6,098,795 A 8/2000 Mollstam et al.
6,116,445 A 9/2000 Ikemori et al.
6,148,996 A 11/2000 Morini
6,230,884 B1 5/2001 Coory
6,257,463 B1 7/2001 De Polo
6,305,576 B1 * 10/2001 Leoncavallo ..... B65D 51/2814 206/222
6,364,103 B1 4/2002 Sergio et al.
6,372,270 B1 4/2002 Denny
6,412,659 B1 7/2002 Kneer
6,435,341 B1 8/2002 Nobbio
6,450,367 B1 9/2002 Sittler
6,477,743 B1 11/2002 Gross et al.
6,513,650 B2 2/2003 Mollstam et al.
RE38,067 E 4/2003 Gueret
6,571,994 B1 6/2003 Adams et al.
6,609,634 B2 8/2003 De Laforcade et al.
6,644,471 B1 11/2003 Anderson
6,679,375 B1 1/2004 Coory
6,763,939 B2 7/2004 Alticosalian
6,772,910 B1 8/2004 Coory
6,854,595 B2 2/2005 Kiser
6,874,661 B2 4/2005 Timmerman et al.
6,908,011 B2 6/2005 Cho
6,921,087 B2 7/2005 Takahashi et al.
6,926,138 B1 8/2005 Basham et al.
7,055,685 B1 6/2006 Patterson et al.
7,175,049 B2 2/2007 Kastenschmidt et al.
7,249,690 B2 7/2007 Smith et al.
7,252,091 B1 8/2007 Wayne et al.
7,261,226 B2 8/2007 Adams et al.
7,325,676 B2 2/2008 Galaz Rodriguez
7,377,383 B2 5/2008 Henry
7,464,811 B2 12/2008 Patterson et al.
7,503,453 B2 3/2009 Cronin et al.
7,562,782 B2 7/2009 Yorita
7,568,576 B2 8/2009 Sweeney, Jr. et al.
7,614,513 B2 11/2009 Anderson
7,854,104 B2 12/2010 Cronin et al.
7,874,420 B2 1/2011 Coon
7,886,922 B2 2/2011 Seelhofer
7,900,787 B2 3/2011 Oh et al.
7,951,109 B2 5/2011 Anderson
8,083,055 B2 12/2011 Simonian et al.
8,141,700 B2 3/2012 Simonian et al.
8,215,481 B1 7/2012 Knickerbocker
2002/0040856 A1 4/2002 Mollstam et al.
2003/0072850 A1 4/2003 Burniski
2004/0020797 A1 2/2004 Fontana
2004/0112770 A1 6/2004 Oswald
2004/0188465 A1 9/2004 Timmerman et al.
2004/0200740 A1 10/2004 Cho
2004/0200741 A1 10/2004 Cho
2005/0115845 A1 6/2005 Cho
2005/0161348 A1 7/2005 Morini
2005/0236424 A1 10/2005 Walters et al.
2006/0006077 A1 1/2006 Mosher et al.
2006/0118435 A1 6/2006 Cronin et al.
2007/0051689 A1 3/2007 Anderson
2008/0125704 A1 5/2008 Anderson
2008/0202950 A1 8/2008 Anderson
2009/0020494 A1 1/2009 Seelhofer
2009/0308831 A1 12/2009 Anderson
2010/0000960 A1 1/2010 Anderson
2010/0200437 A1 8/2010 Coon
2011/0290677 A1 12/2011 Simonian et al.
2011/0290678 A1 12/2011 Simonian et al.
2012/0199503 A1 * 8/2012 Dyrbye ..... B65D 47/243 206/222

* cited by examiner

TWO-PIECE DOUBLE-SEALED DISPENSING CAPSULE WITH BUTTON BLAST AND DRINK THROUGH FEATURE

CROSS REFERENCE TO RELATED APPLICATIONS

This application is a continuation-in-part of co-pending U.S. patent application Ser. No. 13/752,493 filed on Jan. 29, 2013, which is a continuation-in-part of U.S. patent application Ser. No. 13/478,419 filed May 23, 2012, which claims the benefit of priority to U.S. Provisional Patent Application No. 61/490,971 filed May 27, 2011. This application is also a continuation-in-part of co-pending U.S. patent application Ser. No. 13/480,958 filed May 25, 2012, which claims the benefit of priority to U.S. Provisional Patent Application No. 61/490,920 filed May 27, 2011.

STATEMENT REGARDING FEDERALLY SPONSORED RESEARCH OR DEVELOPMENT

N/A

BACKGROUND OF THE INVENTION

Most if not all liquids, creams, gels and even certain powders and other substances are formulated and created for the longest shelf life and not necessarily for optimal performance and/or usefulness. There are many ingredients and/or combinations of ingredients that have reduced shelf life due to requiring combinations of liquid substances. In most all cases when any ingredients are exposed to one another, including air, deterioration begins and the clock on the limited shelf life starts. Also in most products in any category, "Shelf Life" is the key factor with respect expiration dates based on the product and category.

Several attempts have been made to design capsules and containers to improve the shelf life of compositions such as gels, liquids, powders and the like however the majority of the available devices rely on a plurality of interconnected parts which are not cost effective to manufacture and assemble. The present invention is designed to be inexpensive to mass produce, fill and seal to be able to deliver an affordable dispensing capsule in virtually any application and category. This invention can be made from a one piece mold or more pieces depending on the desired application with features and benefits for keeping ingredients separate and fresh until time of use. This invention allows formulas and new products in any categories to be invented and made for desired end effects and not for what has to be done do to normal packaging and manufacturing and eliminating many unhealthy ingredients that are currently and normally used to produce most products. The present invention, therefore, is useful for packaging ingredients such as enzymes, calcium and magnesium with bio flavinoids vitamin C, probiotics creatine and many more. Moreover, the present invention allows for the mixing of a plurality of ingredients by providing a multi-chambered dispenser configuration. This provides a substantial improvement over the prior art with respect to shelf life and overall versatility.

It is, therefore, to the effective resolution of the aforementioned problems and shortcomings of the prior art that the present invention is directed. However, in view of the container capsules and related devices in existence at the time of the present invention, it was not obvious to those persons of ordinary skill in the pertinent art as to how the identified needs could be fulfilled in an advantageous manner.

DETAILED DESCRIPTION

Figure 1:
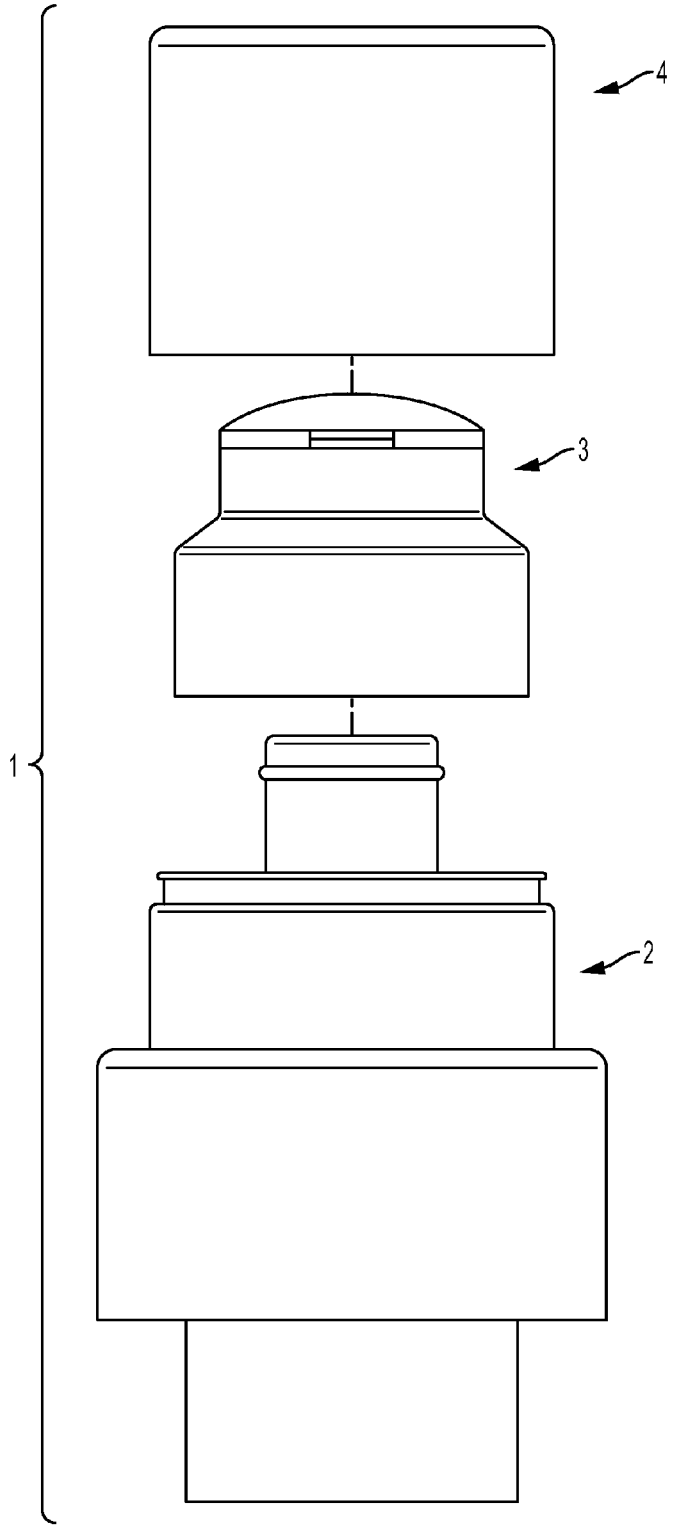
FIG. 1 is an exploded view of one embodiment of the dispensing capsule of the present invention.

FIG. 1 is an exploded view of one embodiment of the dispensing capsule 1. The dispensing capsule 1 generally comprises a capsule body 2 and an actuating drink-through cap 3. The actuating drink-though cap is slidingly engaged with the top of the capsule body 2. In some embodiments, a dust cover 4 is removably received on the capsule body 2 and is configured to entirely cover the drink-through cap 3 to prevent premature actuation of the capsule 1.

Figure 2A:
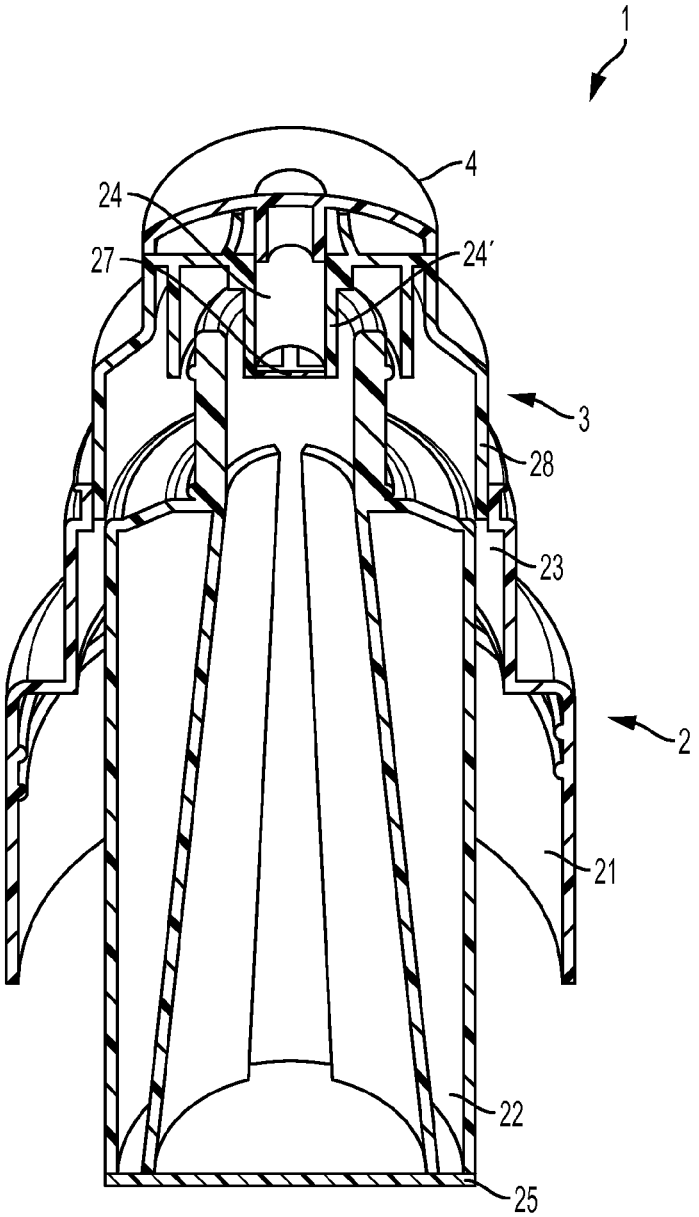
FIG. 2A is a perspective view of the dispensing capsule.

FIG. 2A is a perspective view of the assembled dispensing capsule 1. The cap body 2 is configured to be removably received on a target container such that the capsule can dispense one or more ingredients into the container for mixture and eventual use. In some embodiments, the cap body 2 is generally cylindrical having a container connector 21, a chamber 22, and an actuator base 23. In some embodiments, the upper container connector 21 defines the outer cylindrical surface of the dispensing capsule and surrounds chamber 22. The chamber 22 is disposed inside and extends through the container connector 21 and, in some embodiments, is cylindrical and coaxial with the container connector 21. In some embodiments, the chamber 22 is smaller in diameter than the container connector 21 such that the upper container connector 21 can fit around an open top or spout of a container with the chamber 22 disposed partially in the container, typically within the neck of the target container, as shown and described further below. Extending upward from the container connector 21 is an actuator base 23 which, in some embodiments, is cylindrical and coaxial with the container connector 21 and chamber 22. The actuator base 23 surrounds the upper portion of the chamber 22 toward the top of the capsule 1. A nozzle 24 extends upward from the chamber 22. One or more ingredients 22*a* are contained in the chamber 22, which chamber 22 is sealed at the bottom by a lower sealing member 25. In some embodiments, the nozzle 24 is sealed by an upper sealing member 27. In some embodiments, dust cover 4 is releasably engaged around a lip 28 provided around the top of the chamber 22 of the cap body 2. In some embodiments, the dust cover 4 entirely covers the actuation cap 3, preventing premature activation of the device.

Figure 2B:
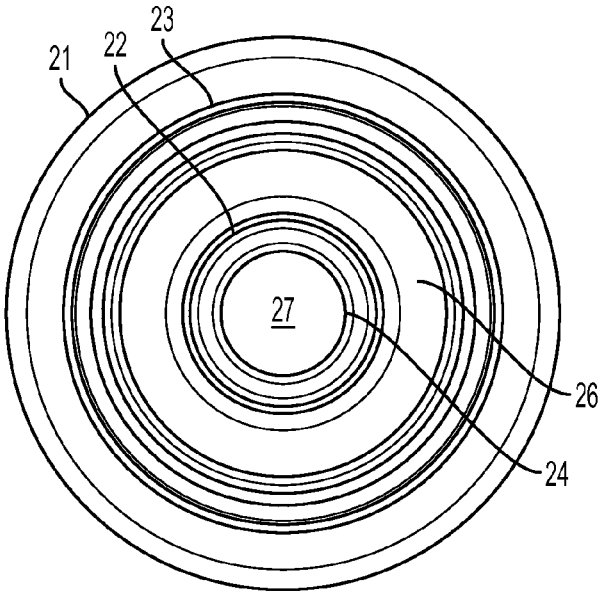
FIG. 2B is a top view of the dispensing capsule with the actuation cap removed.

FIG. 2B is a top view of the capsule 1 showing arrangement of the various components of the cap body 2. Container connector 21 is axially aligned with actuator base 23, chamber 22, and nozzle 24. The base 24' of nozzle 24 is attached to the top of the chamber 22 by a flexible actuator 26. In some embodiments, the flexible actuator 26 comprises a stepped or bellow configuration such that, in combination with nozzle 24 and the actuating drink-through cap 3, the actuator 26 provides a dispensing button feature to dispense the ingredients 22*a*. Also seen in FIG. 2B is the upper sealing member 27 which is disposed within nozzle 24. Optionally provided at the top of the cap body 2 is a removable dust cover 4.

Figure 3A:
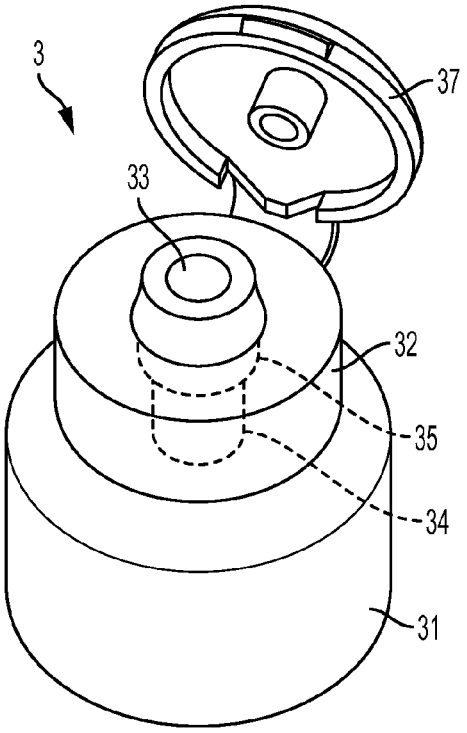
FIG. 3A is a perspective view of the actuation cap of the dispensing capsule.
Figure 3B:
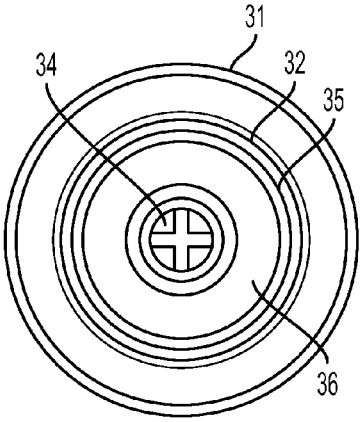
FIG. 3B is a bottom view of the actuation cap of the dispensing capsule.

As noted above, the actuating drink-through cap 3 is slidingly engaged with the capsule body 2. FIGS. 3A and 3B show the actuating drink-through cap 3 in isolation. Cap 3 comprises a cylindrical base 31, a cylindrical upper portion 32 extending upward from the base 31, and a spout 33 extending upward from the upper portion 32. Internally, a hollow punch 34 extends downward from the upper portion 32. As seen in FIG. 2B, punch 34 is encircled by an outer race 35 which delimits a groove 36 between the punch 34 and the race 35. In some embodiments, the base 31, upper portion 32, spout 33, punch 34, and race 35 are coaxial. In some embodiments, a hingeable lid 37 is attached to the upper portion 32 of the actuation cap 3 and is releasably retained by spout 33.

As shown in FIG. 2A, the cylindrical base 31 of the actuation cap 3 is received at the top of cap body 2 between the actuator base 23 and the chamber 22. In some embodiments, cap 3 is snap-fit or releasably retained by the cap body 2 but is slideable to facilitate the actuation action of the dispensing capsule 1. In some embodiments, the nozzle 24 is received within the groove 36 of the cap 3 such that the nozzle 24 and punch 34 are aligned. This arranges the punch 34 in a manner by which it can break the seal 27 disposed within nozzle 24 when the device is actuated. Additionally, this arrangement is effective for stabilizing the engagement of the cap 3 to the cap body 2. The spout 33 of the cap 3 is also generally aligned with the chamber 22 of the cap body 2 such that the cap 3 and cap body 2 are in flow communication.

Figure 4A:
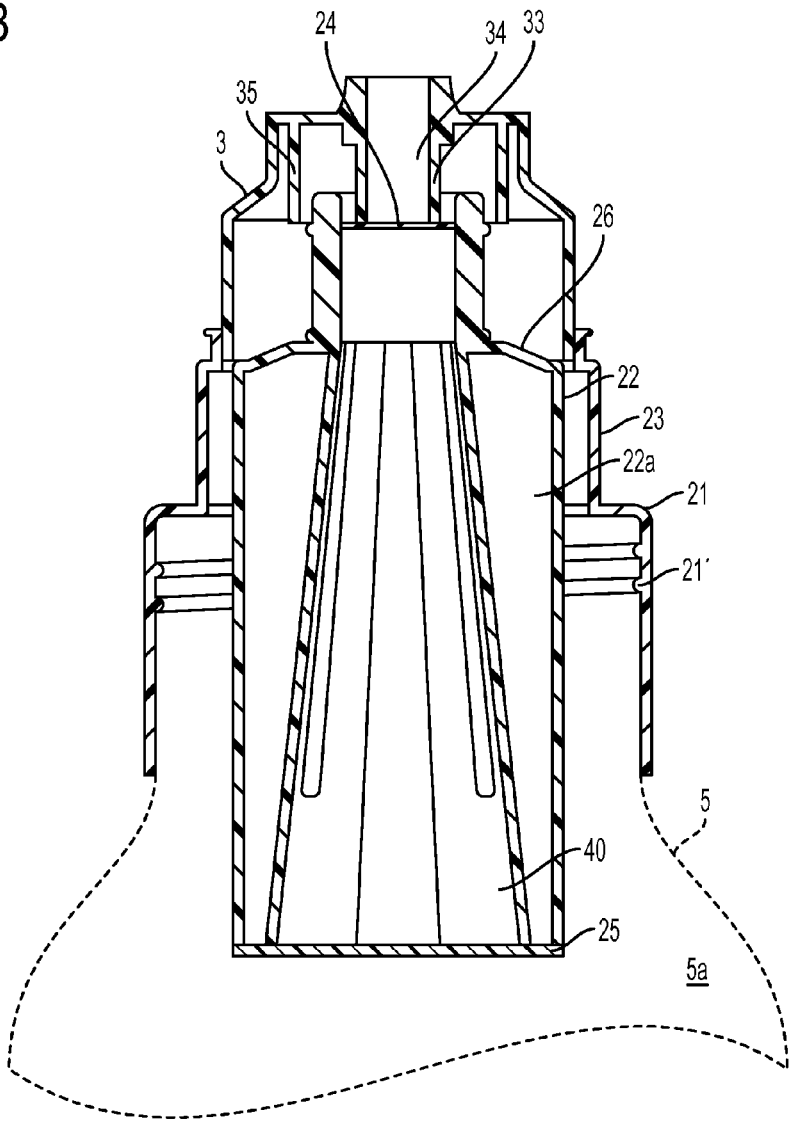
FIG. 4A is a section view of one embodiment of the dispensing capsule of the present invention in a pre-activation state.
Figure 4B:
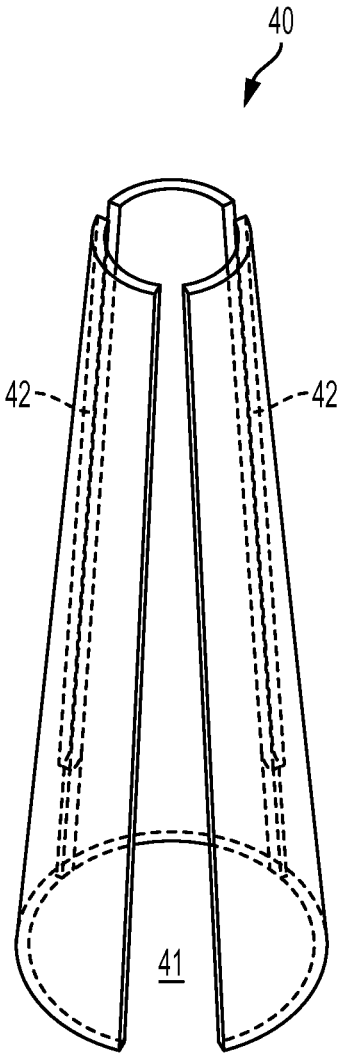
FIG. 4B is a close up view of the plunger of the dispensing capsule.
Figure 4C:
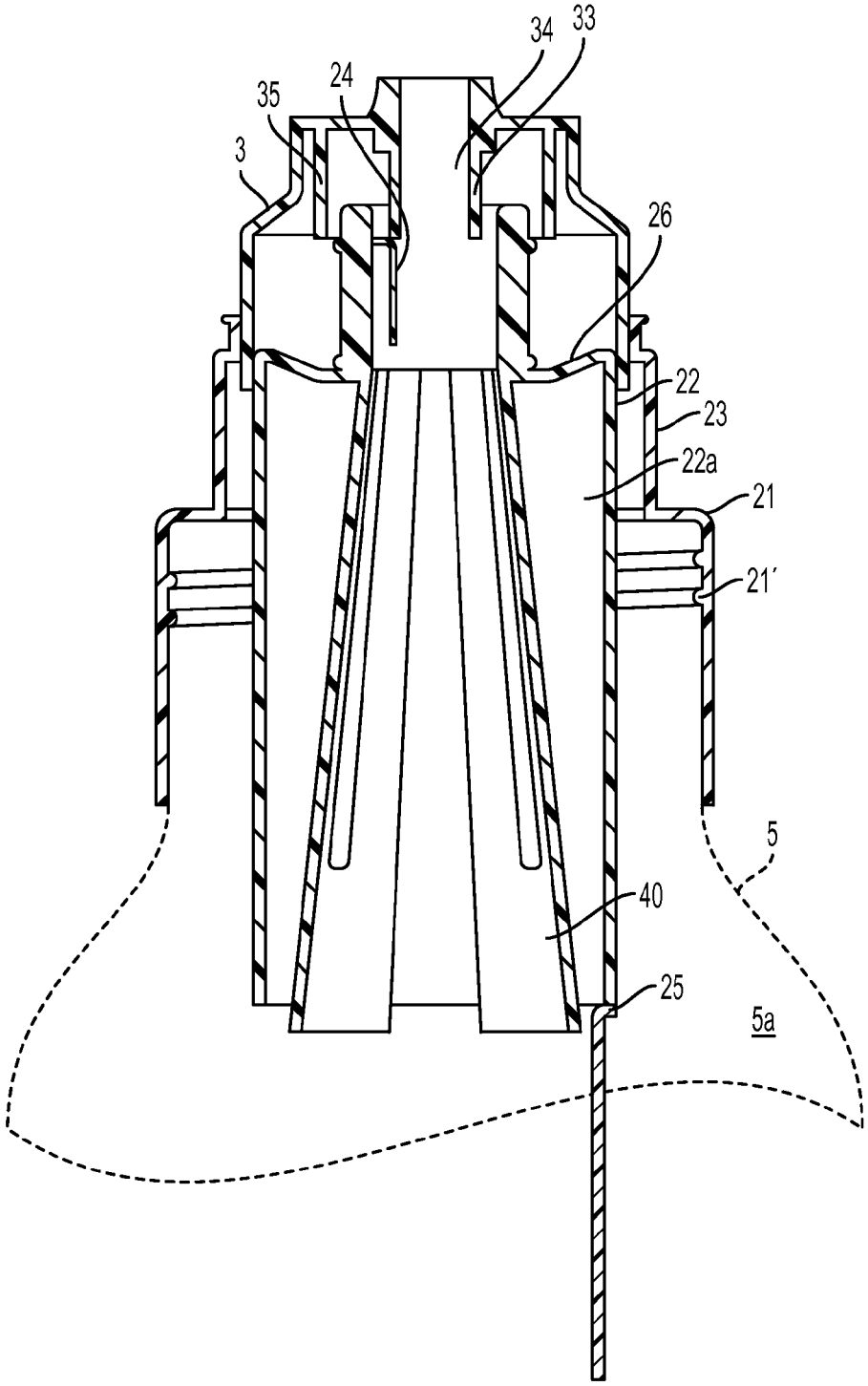
FIG. 4C is a section view of one embodiment of the dispensing capsule of the present invention in an actuated state.

As shown in FIGS. 4A-4C, actuation of the dispensing capsule 1 is accomplished by way of a plunger 40 which is disposed within chamber 22. In some embodiments, plunger 40 is an extension of nozzle 24 projecting into the chamber 22 from the underside of the nozzle 24. In some embodiments, plunger 40 has a generally conical shape diverging away from nozzle 24. The plunger 40, by way of nozzle 24, is engaged with the flexible actuator 26. As shown in FIG. 4B, in some embodiments, plunger 40 has a triangular cutaway 41 along its surface area and may further include one or more vent windows 42 disposed in spaced apart relation on the surface of the plunger 40. The vent windows 42 help the disbursement of the ingredients from the device when it is activated and also help and allow expeditious filling of the ingredients into the chamber during manufacture and before the device is sealed. In some embodiments, the plunger 40 has an angled or beveled distal tip 43 which is effective for piercing or breaking lower sealing member 25. It is appreciated that the dispensing capsule is sealed at the top by way of the upper sealing member 27 inside nozzle 24 and at the bottom by sealing member 25 such that the device is capable of sealingly containing the one or more ingredients 22*a* to be dispensed.

With reference to FIG. 4A, shown is a section view of the dispensing capsule of the present invention in a pre-actuated state. Here, the cap body 2 is removably received on a container 5. Shown are inner threads 21' which are disposed on an inner portion of the upper container connector 21. Threads 21' are configured to threadingly engage a target container. In some embodiments, threads 21' of cap body 2 are engaged with corresponding container threads of a target container 5. Other engagements, such as snap fitments and the like may be as equally suitable as the threaded engagement. From here it can be seen that, which the capsule 1 seated on target container 5, the chamber 22 of cap body 2 is received in the neck of the container 5 and is ready for actuation. Disposed within chamber 22 are one or more ingredients 22*a*. In some embodiments, container 5 may contain a second ingredient 5*a*. Towards the top of the device, actuation cap 3 is installed on cap body 2 and the punch 34 is engaged with nozzle 24. In some embodiments, this engagement is at least semi-permanent such that the actuation cap 3 and nozzle 24 move in unison during and after activation.

With reference to FIGS. 4A and 4C, in order to actuate the device, manual or automatic pressure is applied downwardly to actuation cap 3. This pressure causes the punch 34 of the actuation cap 3 to act downwardly on the nozzle 24, puncturing or breaking upper sealing member 27 and deforming the flexible actuator 26 such that the entire nozzle 24-plunger 40 element moves downwardly within chamber 22. Plunger 40 displaces downward inside chamber 22 until the distal tip 43 punctures and/or breaks sealing member 4, causing the ingredients 22*a* to be dispensed from the cap body into container 5. In the case where container 5 contains a second ingredient 5*a*, the two ingredients mix.

After the dispensing capsule 1 has been actuated, it can be utilized a drinking device to directly access the now-mixed contents of the target container. Accordingly, as mentioned above, the cap body 2 and actuation cap 3 are in flow communication, namely by way of chamber 22, which leads up to nozzle 24 which is in flow communication with punch 34 and ultimately spout 33. This provides a flow passage through which the contents of the target container 5 can be accessed for drinking or other purposes without the need to remove the capsule 1 from the container 5. Of course, after actuation, the flow of liquid through and out of the capsule 1 can be prevented by closing hinged lid 37. Hinged lid 37, therefore, permits selective access to the mixture contained in container 5 once the capsule 1 has been actuated.

To further enhance the usability and effectiveness of the dispensing capsule 1, the window vents 42 are provided in plunger 40 to assure that the one or more ingredients 22*a* are entirely cleared from the dispensing capsule. To that end, the window vents 42 allow the flow of liquid and in and out of the chamber 22 to allow for the chamber 22 to be completely flushed of ingredients 22*a* after actuation. Flushing the capsule 1 after actuation can be accomplished by upending the container 5 (with capsule 1 installed) or by shaking or otherwise disturbing the device such that a sufficient amount of liquid enters the dispensing capsule 1 from the bottom. This helps to alleviate the problem of residue build up or unused ingredients 22*a* remaining in the chamber 22, particularly in the vicinity of the lower sealing member 25. The window vents 42 also promote the flow of liquid back through the entire dispensing capsule 1 when used from drinking, for example, by way of spout 33 of the actuation cap 3.

In some embodiments, the capsule 1 includes actuation cap 3 including an internal punch 34, a cap body 2 including a container connector 21, a chamber 22 disposed in the container connector and sealed by a lower sealing member 25, and an actuator base 23 extending above said container connector 21 and surrounding a top portion of the chamber 22. Nozzle 24 is attached to chamber 22 by a flexible actuator 26 disposed circumferentially around the nozzle 24. Nozzle 24 is sealed by an upper sealing member 27. A moveable plunger 40 extends downward from nozzle 24 and is disposed within chamber 22. The plunger 40 includes one or more window vents 42 to facilitate the flow of liquid into and out of said chamber. Actuation cap 3 is slidingly engaged with cap body 2 at the actuator base 23. Upon application of pressure to actuation cap 2, the internal punch 34 engages nozzle 24 causing plunger 40 to displace downward and at least partially break lower sealing member 25. One or more ingredients 22*a* are contained in the chamber 22 which, upon actuation, are dispensed into a target container for mixture and use. The punch 34 of the actuation cap 3 is also capable of breaking the upper sealing member 27 disposed within nozzle 24 to provide drink-through access to the eventual mixture.

It is appreciated that the capsule of the present invention can comprise any combination of materials including plastics, rubbers, aluminum, resins, and the like. The capsule may also be sized and shaped to accommodate fitment on any desired container such as bottles, IV bags, pouches, and the like. Furthermore, the threaded engagement with the container may be substitute for various snap-on or other releasable fitments known in the art.

It is further appreciated that the upper sealing member 27 and lower sealing member 25 may comprise a variety of plastic and foil-like materials. In some embodiments, the sealing members comprise a thin plastic or resin material having one or more lines of weakening to allow for dispensing of the first ingredient. In other embodiments, the sealing members may comprise a foil or paper material equally suitable to be broken by the plunger action described above.

The chamber 22 can contain any liquid, powder and or gasses and or micro/nano encapsulation in any combination desired. The dispensing capsule can be mounted or applied at any location of a container including a bottle, pouch, can, IV bag, drum or tote. In some embodiments, the capsule is suited to be received on the threaded opening of such containers in order to provide a leak-free fitment. The chamber of the dispensing capsule stores any desired ingredient and may be dimensioned as desired to fit a variety of applications. The size and shape of the capsule of the present invention should not be construed as limited to the sizes and shapes shown in the drawings herein. Rather, the volume of the chamber and the diameter of the various components can vary as desired and/or can vary depending on the size and shape of the intended container or other parameters. Further, the chamber need not be filled completely, but rather can accept any volume of an ingredient desired depending on mixing parameters and the desired final product.

By way of example only, the device can be used for drinks, hair care, pet products, drugs, over the counter medications, cleaning products, soups, dressings, nitrogen, fuels and engine cleansing, oils, waxes, pH enhancers, oral care, oxygen, adhesives and other categories of use depending on the ingredients and formulas. It is appreciated that the dispensing capsule allows for on-demand dispensing of a product or component of a product for mixing with another ingredient or ingredients in the container to which it is attached. Also a coating of any type of moisture absorbent can be applied to the inside of the chamber to act as a desiccant and allow for moisture absorption of any excess moisture that may be contained inside the invention when filled and sealed.

This dispensing capsule can be molded in two pieces, i.e. cap 3 and cap body 2, thus eliminating a high cost to manufacture other dispensing caps that are multiple pieces and difficult to fill and seal the ingredients desired. Furthermore, due to the encapsulated capsule excluding the sealing area the invention allows the ingredients to remain moisture free and have an unusually long shelf life and allowing with the sealed chamber to combine liquids and powders and oils and other ingredients to be sealed and stored separately if desired to prevent any reaction with one another.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A dispensing capsule, comprising:

an actuation cap including an internal punch;

a cap body including a container connector, a chamber disposed in said container connector and sealed by a lower sealing member, and an actuator base extending above said container connector surrounding a top portion of said chamber;

a nozzle attached to said chamber by a flexible stepped actuator, said nozzle sealed by an upper sealing member;

a moveable conical-shaped plunger having a triangular cutaway extending downward from said nozzle and disposed within said chamber and having an beveled distal tip;

wherein said actuation cap is seated in a groove located between said chamber and said actuator base such that said actuation cap is slidingly engaged with said cap body at said actuator base; and wherein upon application of pressure to said actuation cap, said internal punch engages said nozzle causing said plunger to displace downward such that said beveled distal tip at least partially breaks said lower sealing member.

2. The dispensing capsule of claim 1, wherein said chamber is configured to store one or more ingredients to be dispensed therefrom.

3. The dispensing capsule of claim 1, wherein said internal punch is configured to at least partially break said upper sealing member upon application of pressure thereon.

4. The dispensing capsule of claim 1, wherein said container connector is configured to attached to a target container.

5. The dispensing capsule of claim 1, wherein said actuation cap includes a hingeable lid.

6. The dispensing capsule of claim 1, wherein said actuation cap is in flow communication with said cap body.

7. The dispensing capsule of claim 1, wherein said actuation cap includes a spout in flow communication with said chamber of said cap body.

8. The dispensing capsule of claim 1, wherein said container connector, said actuator base, and said chamber are axially aligned.

* * * * *